US009640913B1

(12) United States Patent
Wang

(10) Patent No.: US 9,640,913 B1
(45) Date of Patent: May 2, 2017

(54) ELECTRICAL CONNECTOR

(71) Applicant: UNIconn Corp., New Taipei (TW)

(72) Inventor: Chih-Shou Wang, New Taipei (TW)

(73) Assignee: UNICONN CORP., New Taipei (TW)

( * ) Notice: Subject to any disclaimer, the term of this patent is extended or adjusted under 35 U.S.C. 154(b) by 0 days.

(21) Appl. No.: 15/158,087

(22) Filed: May 18, 2016

(30) Foreign Application Priority Data

Dec. 31, 2015 (TW) ..... 104221274 U

(51) Int. Cl.
*H01R 9/05* (2006.01)
*H01R 13/6461* (2011.01)

(52) U.S. Cl.
CPC ..... *H01R 13/6461* (2013.01)

(58) Field of Classification Search
CPC ..... H01R 13/658; H01R 13/65802; H01R 13/6658; H01R 43/24; H01R 9/032; H01R 13/65807; H01R 9/0757; H01R 23/662; H01R 9/05; H01R 9/0515; H01R 24/40; H01R 24/50; H01R 2103/00
USPC ..... 439/497, 581, 607.58
See application file for complete search history.

(56) References Cited

U.S. PATENT DOCUMENTS 6,394,842 B1 * 5/2002 Sakurai ..... H01R 23/688 439/352
6,869,308 B2 * 3/2005 Wu ..... H01R 12/62 439/497
7,498,523 B2 * 3/2009 Miller ..... H01R 9/0515 174/261
8,039,746 B2 * 10/2011 Ashida ..... H01R 12/592 174/88 R
8,115,107 B2 * 2/2012 Behziz ..... H01R 9/0515 174/250
8,439,706 B2 * 5/2013 Sytsma ..... H01R 13/65802 439/607.19
8,628,349 B2 * 1/2014 Kim ..... H01R 12/79 439/497
8,787,743 B2 * 7/2014 Sekido ..... A61B 1/00124 174/74 R
9,011,179 B2 * 4/2015 Siahaan ..... H01R 13/504 439/606
9,240,656 B1 * 1/2016 Long ..... H01R 13/6581
9,271,391 B2 * 2/2016 Okayama ..... H05K 1/0237
9,356,365 B2 * 5/2016 Yamada ..... H01R 9/0515
9,466,925 B2 * 10/2016 Rost ..... H01R 9/032
2014/0206230 A1 * 7/2014 Rost ..... H01R 9/032 439/607.01

* cited by examiner

*Primary Examiner* — Abdullah Riyami
*Assistant Examiner* — Vladimir Imas
(74) *Attorney, Agent, or Firm* — AEON Law; Adam L. K. Philipp; Manasi Vakil

(57) ABSTRACT

An electrical connector provided in the present invention comprises a circuit board and a connecting wire member. The circuit board includes an upper circuit layer, a lower circuit layer, and a shielding layer. The connecting wire member includes a plurality of upper wires and a plurality of lower wires. The upper circuit layer has an upper concave portion made by removing circuit, and the lower circuit layer has a lower concave portion made by removing circuit. The upper wire set is disposed in the upper concave portion, and the lower wire set is disposed in the lower concave portion. Thus, the shielding between the upper wire set and the lower wire set is achieved, and the assembling and processing of wires and circuit layer is easier.

5 Claims, 3 Drawing Sheets

ELECTRICAL CONNECTOR

FIELD OF THE INVENTION

The present invention relates to an electrical connector, and more particularly to an electrical connector, configured with low profile, achieving an effect of signal shielding.

BACKGROUND OF THE INVENTION

The electrical connector is a device electrically connected to circuit boards, electronic components or electronic products. With personal computers, personal digital assistants (PDA), smart phones and tablet personal computers and other digital electronic devices are going popular, the electrical connector has become an indispensable intermedium for signal transmission in our daily life. In recent years, a Low Voltage Differential Signal (LVDS) connector has become apparent, which transmits data by very low voltage amplitude and high-speed differential, and has the advantages of low power consumption and low error rate.

However, the frequency of this type of high-speed connectors is usually up to several GigaHertz (GHz) when signals are being transmitted. As a result, while transmitting signals, it is easy to be affected by noise. As shown in FIG. 4, the LVDS connector comprises a circuit board, with reference word of "a", a upper wire R1 and a lower wire R2 which are connected to a top and a bottom of the circuit board, with reference word of "a", respectively. Since a gap S is inevitably occurred between the backend of the circuit board and the wires during manufacture, the exposing portion of the upper wire R1 and the lower wire R2 at the gap S cannot form an effective shield by the circuit board. Therefore, the signals transmitted by the upper wire R1 and the lower wire R2 will interfere with each other and the signal interference (CROSSTALK) occurs, which affects the transmission quality of the original signals.

In the prior art, as shown in FIG. 5, for preventing abovementioned signal interference of the upper wire and the lower wire, the resolution as shown in FIG. 5 makes the circuit board, with reference word of "b", be allocated at backwards side and be sandwiched between the upper wire R3 and the lower wire R4 for forming shielding. However, this configuration leads to a multilayer structure due to the circuit board being sandwiched between the upper wire and the lower wire. The core wires have to be pre-processed and shaped in advance, resulting increase of working hours and uncertainty. Additionally, the thickness of the core wires is also increased considerably, which causes the volume of final product increased to be unfavorable for usage.

SUMMARY OF THE INVENTION

Accordingly, the objective of the present invention is to provide an electrical connector, configured with low profile, achieving an effect of signal shielding.

The electrical connector of the present invention comprises a circuit board and a connecting wire member. The circuit board includes an upper circuit layer, a lower circuit layer, and a shielding layer. The outer surface of the upper circuit layer has an upper contact point, and the outer surface of the lower circuit layer has a lower contact point. The connecting wire member includes an upper wire set and a lower wire set in such a manner that the upper wire set includes a plurality of upper wires and the lower wire set includes a plurality of lower wires. The upper wire and the lower wire respectively include a plurality of conductive core wires, an insulating cladding portion, a conductive shielding portion, and an external insulating cladding portion. The insulating cladding portion covers the plurality of conductive core wires, the conductive shielding portion covers the insulating cladding portion, and the external insulating cladding portion covers the conductive shielding portion. The conductive core wire of the upper wire has an upper-core-wire exposing portion being exposed from the conductive shielding portion. The conductive core wire of the lower wire has an lower-core-wire exposing portion being exposed to the conductive shielding portion by which the upper-core-wire exposing portion and the lower-core-wire exposing portion are electrically connected to the upper contact point and the lower contact point respectively. Wherein the upper circuit layer has an upper concave portion provided by removing circuit located thereon, the lower circuit layer has a lower concave portion provided by removing circuit located thereon, in which the upper concave portion and the lower concave portion are provided as corresponding to each other vertically. The upper wire set is disposed in the upper concave portion and the lower wire set is disposed in the lower concave portion in such a manner that the shielding layer is disposed between the upper-core-wire exposing portion of the upper wire set and the lower-core-wire exposing portion of the lower wire set to which the shielding layer divides therebetween.

According to one embodiment of the present invention, the upper circuit layer and the lower circuit layer are rigid structural layers, and the shielding layer is a flexible structural layer.

According to one embodiment of the present invention, the upper circuit layer, the lower circuit layer and the shielding layer are rigid structural layers.

According to one embodiment of the present invention, the shielding layer includes an upper metal layer, a lower metal layer, and an insulating layer which is provided as sandwiched between the upper metal layer and the lower metal layer.

According to one embodiment of the present invention, the upper wire set and the lower wire set include a plurality of ground wires respectively, the ground wires are provided as sandwiched between the insulating cladding portion and the external insulating cladding portion, and the ground wires are electrically connected to a ground point of the upper circuit layer and a ground point of the lower circuit layer respectively.

By means of the technology of the present invention, it requires only an extremely thin shielding portion sandwiched between the upper wire set and the lower wire set, without requiring the whole circuit board to be sandwiched between the upper wire set and the lower wire set. It thus not only has benefit for the whole electrical connector with a low profile, but also brings the shielding effect of signals while maintaining the stability of signal transmission. Moreover, in the present invention, the ground wires are formed through the shielding portion of the present invention to thus relieve the need of extra ground wires and simplify the design of the electrical connector. Furthermore, in a preferred embodiment of the present invention, the upper-core-wire exposing portion and the lower-core-wire exposing portion are linearly aligned and electrically connected to the upper contact point and the lower contact point respectively, which can prevent from any extra processing and shaping for core wires and from causing variation for the core wires while the thickness of the whole electrical connector become lower. Compared with the structure of circuit board which is overall sandwiched in the prior art, the electrical connector in the present invention is easier for configuration and usage.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

The embodiments of the present invention are described below with reference to FIG. 1 to FIG. 3. The description is for describing the preferred embodiments of the present invention, and is not intended to limit the way of embodying the present invention.

Figure 1:
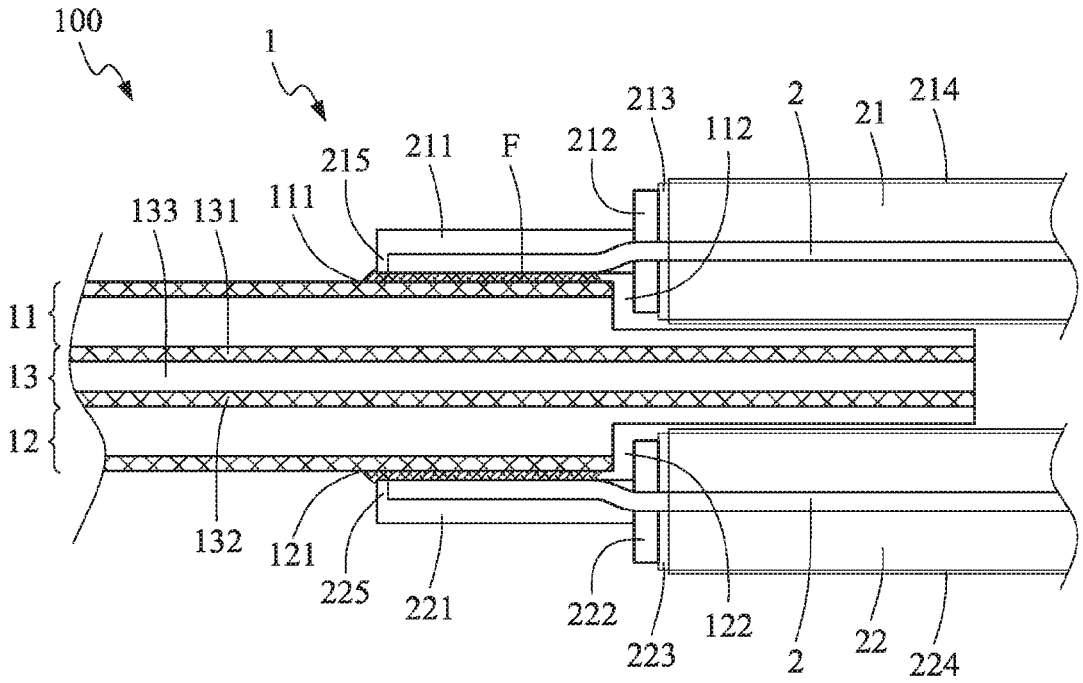
FIG. 1 is a longitudinal sectional view diagram illustrating the electrical connector according to a first embodiment of the present invention.
Figure 2:
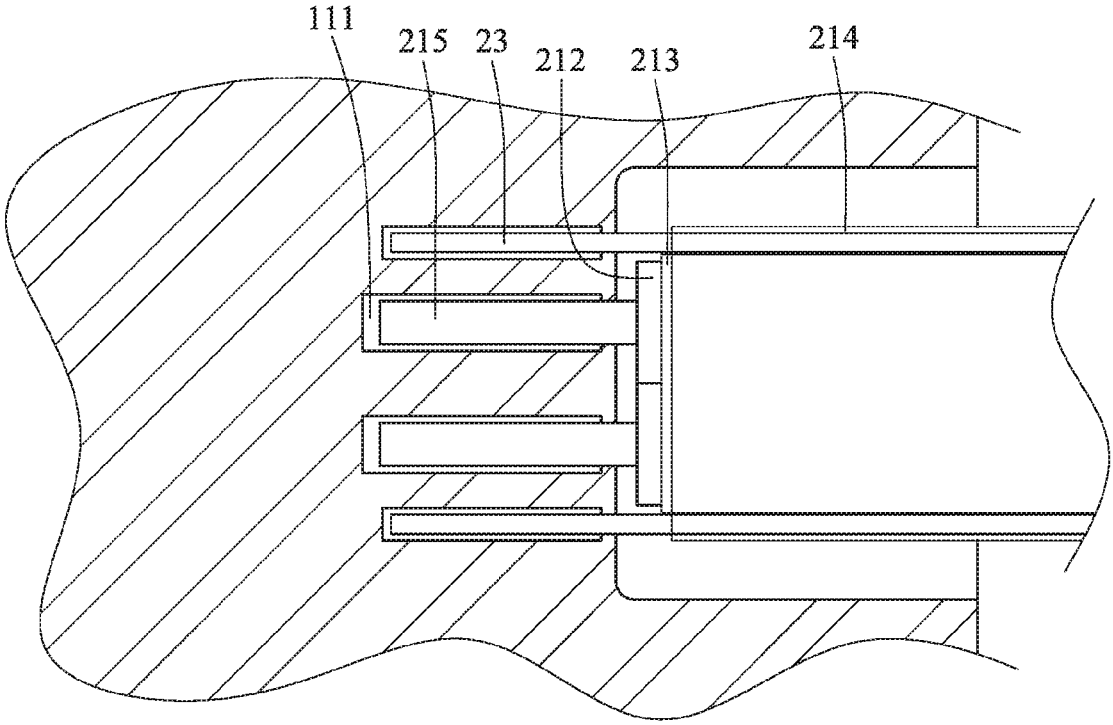
FIG. 2 is a top view diagram illustrating the electrical connector according to the first embodiment of the present invention.

As shown in FIG. 1 and FIG. 2, an electrical connector according to a first embodiment of the present invention comprises a circuit board 1 and a connecting wire member 2.

As shown in FIG. 1 and FIG. 2, the circuit board 1 includes an upper circuit layer 11, a lower circuit layer 12, and a shielding layer 13. In this embodiment, the circuit board 1 is a double-sided printed circuit board (PCB). Certainly, the invention is not limited to this. In other embodiments, the circuit board 1 is a multilayer printed circuit board. The upper circuit layer 11 is a circuit printed on the upper surface of the circuit board 1. The outer surface of the upper circuit layer 11 has an upper contact point 111, and the outer surface of the lower circuit layer 12 has a lower contact point 121. The lower circuit layer 12 is a circuit printed on the lower surface of the circuit board 1 for transmitting signals.

In this embodiment, the upper circuit layer 11 has an upper concave portion 112 provided by removing circuit located thereon, and the lower circuit layer 12 has a lower concave portion 122 provided by removing circuit located thereon. The upper concave portion 112 and the lower concave portion 122 are provided as corresponding to each other vertically. It is worth mentioning that the upper circuit layer 11, the lower circuit layer 12, and the shielding layer 13 are rigid structural layers. It goes without saying that the invention is not limited to this. In other embodiment, the shielding layer 13 is a flexible structural layer.

As shown in FIG. 1 and FIG. 2, the shielding layer 13 is disposed insulatingly between the upper circuit layer 11 and the lower circuit layer 12 for shielding electrical signals transmitted among layers, thus avoiding mutual interference. The shielding layer 13 includes a first metal layer 131, a second metal layer 132, and an insulating layer 133 which is provided as sandwiched between the first metal layer 131 and the second metal layer 132. In this embodiment, the first metal layer 131 and the second metal layer 132 are conductive and flexible metal foils, such as aluminum foils, copper foils, and the like. The insulating layer 133 is fiberglass.

As shown in FIG. 1 and FIG. 2, the connecting wire member 2 is connected to the rear of the circuit board 1 for transmitting signals to the circuit board 1. The connecting wire member 2 includes an upper wire set and a lower wire set. The upper wire set includes a plurality of upper wires 21, and the lower wire set includes a plurality of lower wires 22. Specifically, the conductive core wires used in the upper wires 21 and the lower wires 22 are single solid conductors, stranded conductors, multi-conductor cords, or the like. The material of the conductive core wires are selected, according to a product requirement, from copper, cadmium-copper alloy, or other metal material with high conductivity.

The upper wires 21 and the lower wires 22 include respectively a plurality of conductive core wires 211 and 221, an insulating cladding portions 212 and 222, a conductive shielding portions 213 and 223, and an external insulating cladding portions 214 and 224. The insulating cladding portions 212 and 222 cover the plurality of conductive core wires 211 and 221.

The conductive core wire 211 of the upper wire 21 has an upper-core-wire exposing portion 215 being exposed from the conductive shielding portion 213, and the conductive core wire 221 of the lower wire 22 has an lower-core-wire exposing portion 225 being exposed to the conductive shielding portion 223. The upper-core-wire exposing portion 215 and the lower-core-wire exposing portion 225 are electrically connected to the upper contact point 111 and the lower contact point 121 respectively. In detail, the upper-core-wire exposing portion 215 and the lower-core-wire exposing portion 225 are electrically connected to the upper contact point 111 of the upper circuit layer 11 and the lower contact point 121 of the lower circuit layer 12 respectively by way of welding or conductive adhesive bonding.

Specifically, the upper-core-wire exposing portion 215 and the lower-core-wire exposing portion 225 are linearly aligned and electrically connected to the upper contact point 111 of the upper circuit layer 11 of the circuit board 1 and the lower contact point 121 of the lower circuit layer 12 of the circuit board 1 respectively. Thus, the overall thickness of the electrical connector 100 is reduced.

The insulating cladding portions 212 and 222 are insulating layers covering the plurality of conductive core wires 211 and 221. In this embodiment, the material of the insulating cladding portions 212 and 222 is polyvinyl chloride (PVC), rubber, fiberglass, resin, or the like.

The conductive shielding portions 213 and 223 cover the insulating cladding portions 212 and 222. In detail, the conductive shielding portions 213 and 223 are conductive metal layers covering the upper wire set and the lower wire set, such as copper or aluminum, and which is in a shape of mesh or foil for shielding signals, thus preventing signals from dissipating. The conductive shielding portions 213 and 223 not only protect the conductive core wire from being intervened by external signals, which generates noises, but also prevent the internal signals from intervening the signal transmissions in other conductive core wires. The external insulating cladding portions 214 and 224 are insulating cladding layers covering the conductive shielding portions 213 and 223 for fixing the conductive shielding portions 213 and 223.

Furthermore, the upper wire set and the lower wire set respectively include a plurality of ground wires 23. The ground wires 23 are provided as sandwiched between the insulating cladding portions 212 and 222 and the conductive shielding portions 213 and 223. A portion of the ground wires 23 are exposed to the exterior of the insulating cladding portions 214 and 224 and are electrically connected to the ground points F of the outer spaces of the upper circuit layer 11 of the circuit board 1 and the lower circuit layer 12 of the circuit board 1 respectively. In this design, the conductive shielding layer is extended, and the ground wires 23 are connected to the ground point F, which is further connected to a ground circuit of the circuit board 1, thereby maintaining the quality of signal transmission by keeping the potential of the conductive shielding layer contant.

Figure 3:
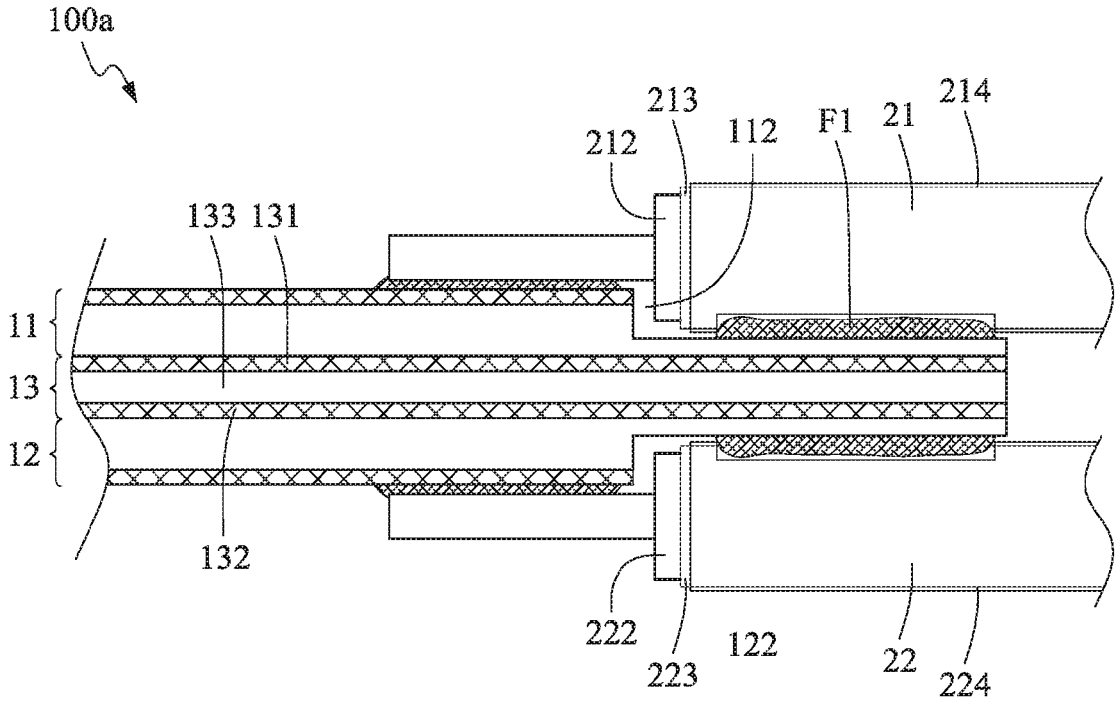
FIG. 3 is a longitudinal sectional view diagram illustrating the electrical connector according to a second embodiment of the present invention.
Figure 4:
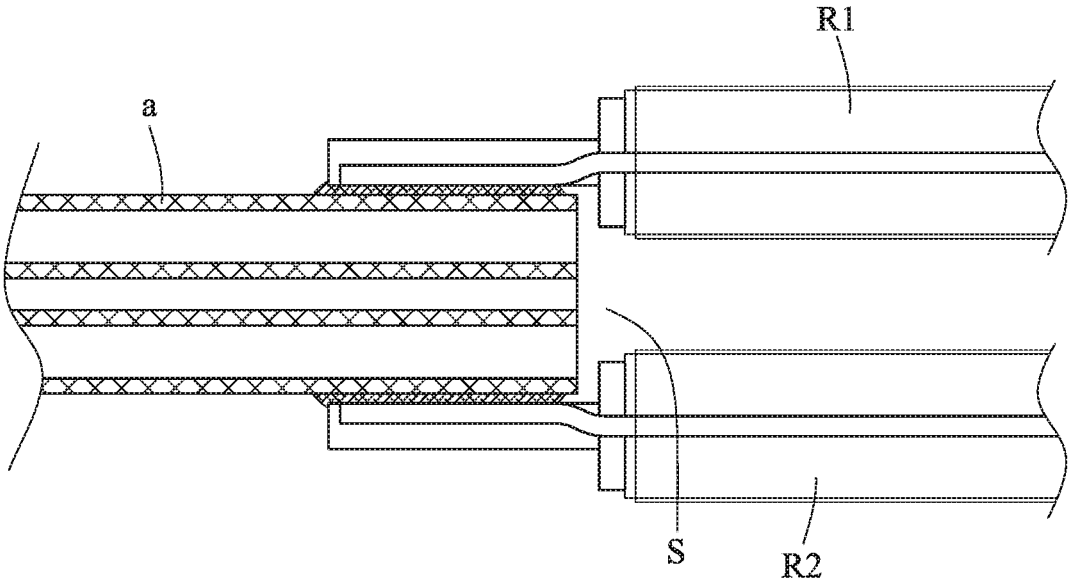
FIG. 4 is a longitudinal sectional view diagram illustrating the electrical connector according to prior art.
Figure 5:
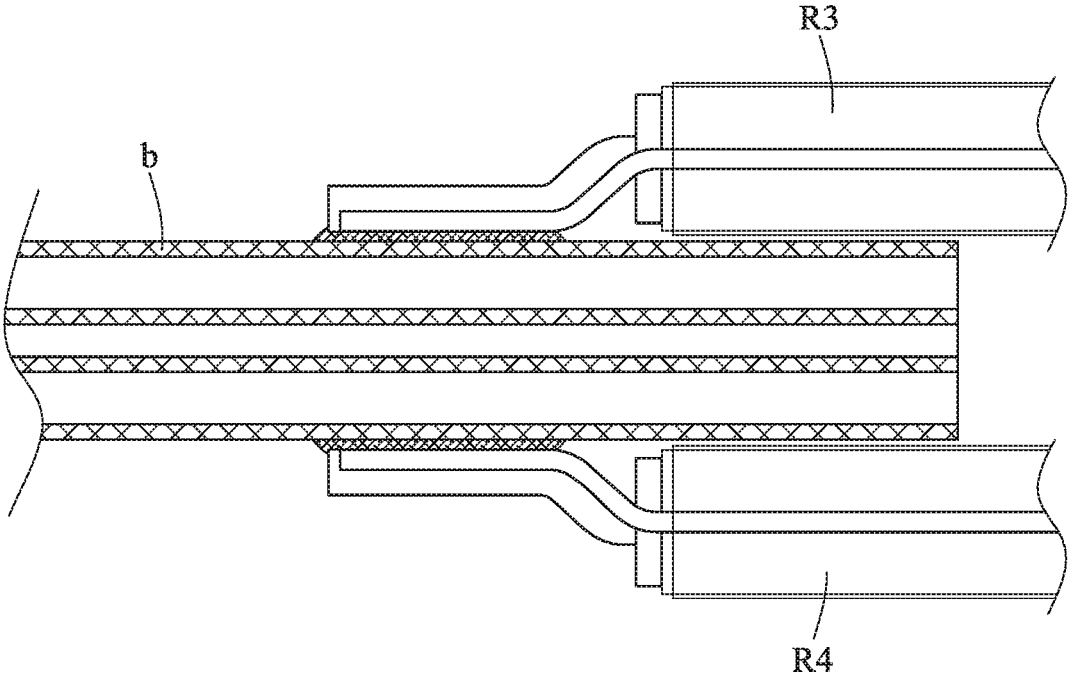
FIG. 5 is a longitudinal sectional view diagram illustrating the electrical connector according to prior art.

As shown in FIG. 3, in another embodiment, it is feasible that the external insulating cladding portions 214 and 224 of the upper wire 21 and the lower wire 22 are electrically connected to the ground points F1. Thus, the ground wires are formed through the shielding portion of the present invention to thus relieve the need of extra ground wires and simplify the design of the electrical connector.

By the above structure, an electrical connector, configured with low profile, achieving an effect of signal shielding is provided in the present invention. It requires only an extremely thin shielding portion sandwiched between the upper wire set and the lower wire set, without requiring the whole circuit board to be sandwiched between the upper wire set and the lower wire set, and it has benefit for the whole electrical connector with a low profile. Compared with the structure of circuit board which is overall sandwiched in the prior art, the electrical connector in the present invention is not only easier for configuration and usage, and but also brings the shielding effect of signals while maintaining the stability of signal transmission. And in the present invention, the ground wires are formed through the shielding portion of the present invention to thus relieve the need of extra ground wires and simplify the design of the electrical connector. Furthermore, the upper-core-wire exposing portion and the lower-core-wire exposing portion are linearly aligned and electrically connected to the upper contact point and the lower contact point respectively, which can prevent from any extra processing and shaping for core wires and from causing variation for the core wires while the thickness of the whole electrical connector become lower.

The above description should be considered as only the discussion of the preferred embodiments of the present invention. A person skilled in the art may make various modifications without deviating from the present invention. However, those modifications still fall within the spirit and scope defined by the appended claims.

What is claimed is:

1. An electrical connector, comprising:

a circuit board including an upper circuit layer, a lower circuit layer, and a shielding layer, wherein the outer surface of the upper circuit layer has an upper contact point, and the outer surface of the lower circuit layer has a lower contact point; and a connecting wire member including an upper wire set and a lower wire set, wherein the upper wire set includes a plurality of upper wires, and the lower wire set includes a plurality of lower wires in such a manner that the upper wire and the lower wire respectively include a plurality of conductive core wires, an insulating cladding portion, a conductive shielding portion and an external insulating cladding portion, wherein the insulating cladding portion covers the plurality of conductive core wires, the conductive shielding portion covers the insulating cladding portion, the external insulating cladding portion covers the conductive shielding portion, the conductive core wire of the upper wire has an upper-core-wire exposing portion being exposed from the conductive shielding portion, the conductive core wire of the lower wire has an lower-core-wire exposing portion being exposed to the conductive shielding portion by which the upper-core-wire exposing portion and the lower-core-wire exposing portion are electrically connected to the upper contact point and the lower contact point respectively, wherein the upper circuit layer has an upper concave portion provided by removing circuit located thereon, the lower circuit layer has a lower concave portion provided by removing circuit located thereon, in which the upper concave portion and the lower concave portion are provided as corresponding to each other vertically, and the upper wire set is disposed in the upper concave portion and the lower wire set is disposed in the lower concave portion in such a manner that the shielding layer is disposed between the upper-core-wire exposing portion of the upper wire set and the lower-core-wire exposing portion of the lower wire set to which the shielding layer divides therebetween.

2. The electrical connector of claim 1, wherein the upper circuit layer and the lower circuit layer are rigid structural layers, and the shielding layer is a flexible structural layer.

3. The electrical connector of claim 1, wherein the upper circuit layer, the lower circuit layer and the shielding layer are rigid structural layers.

4. The electrical connector of claim 1, wherein the shielding layer includes an upper metal layer, a lower metal layer and an insulating layer which is provided as sandwiched between the upper metal layer and the lower metal layer.

5. The electrical connector of claim 1, wherein the upper wire set and the lower wire set include a plurality of ground wires respectively, the ground wires are provided as sandwiched between the insulating cladding portion and the external insulating cladding portion, and the ground wires are electrically connected to a ground point of the upper circuit layer and a ground point of the lower circuit layer respectively.

* * * * *